US009392358B2

(12) United States Patent
DeLay et al.

(10) Patent No.: US 9,392,358 B2
(45) Date of Patent: Jul. 12, 2016

(54) WAVEGUIDE FOR SHAPING SOUND WAVES

(71) Applicant: Robert Bosch GmbH, Stuttgart (DE)

(72) Inventors: Mark DeLay, Saint Paul, MN (US); David Carlson, Savage, MN (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/525,874

(22) Filed: Oct. 28, 2014

(65) Prior Publication Data

US 2016/0119711 A1 Apr. 28, 2016

(51) Int. Cl.
*G10K 13/00* (2006.01)
*H04R 1/28* (2006.01)

(52) U.S. Cl.
CPC ..... *H04R 1/28* (2013.01)

(58) Field of Classification Search
CPC ..... G10K 13/00
USPC ..... 181/196, 185, 192, 187, 188, 155
See application file for complete search history.

(56) References Cited

U.S. PATENT DOCUMENTS

| | | | | |
|---|---|---|---|---|
| 2,001,089 | A * | 5/1935 | Blattner | 181/187 |
| 4,424,881 | A * | 1/1984 | Hattori | 181/155 |
| 4,685,532 | A | 8/1987 | Gunness | |
| 4,776,428 | A * | 10/1988 | Belisle | 181/185 |
| 5,163,167 | A | 11/1992 | Heil | |
| 5,325,096 | A | 6/1994 | Pakett | |
| 6,095,279 | A | 8/2000 | Adamson | |
| 6,628,796 | B2 | 9/2003 | Adamson | |
| 7,278,513 | B2 * | 10/2007 | Brawley, Jr. | 181/176 |
| 7,410,029 | B2 * | 8/2008 | Tanaami | 181/156 |
| 7,584,820 | B2 * | 9/2009 | Parker et al. | 181/155 |
| 7,735,599 | B2 | 6/2010 | Kubota | |
| 8,340,337 | B2 * | 12/2012 | Jiang et al. | 381/345 |
| 2008/0128199 | A1 * | 6/2008 | Magalotti | 181/185 |
| 2012/0268262 | A1 | 10/2012 | Popovic | |
| 2013/0088343 | A1 | 4/2013 | Deigmoller | |
| 2013/0141576 | A1 | 6/2013 | Lord et al. | |
| 2013/0311075 | A1 | 11/2013 | Tran et al. | |

FOREIGN PATENT DOCUMENTS

| | | |
|---|---|---|
| EP | 1178702 | 1/2011 |

OTHER PUBLICATIONS

L'Acoustics VDOSC, K1, K2, Wikipedia page, before Jun. 4, 2014, 4 pages.

JBL's precision-engineered 3rd generation HF waveguide technology producing a properly time-aligned, coherent high frequency wavefront, before Jun. 4, 2014, 12 pages.

Robert Bosch GmbH, Extended Search Report for EP Application No. 15190898.5 dated Apr. 28, 2016 (8 pages).

* cited by examiner

*Primary Examiner* — Forrest M Phillips
(74) *Attorney, Agent, or Firm* — Michael Best & Friedrich LLP

(57) ABSTRACT

An acoustic waveguide includes a plurality of projections to redirect sound waves to obtain a desired wave front, such as a flat plane wave front or an asymmetric curved wave front. The waveguide includes two waveguide members that are mirror images of each other. The waveguide members have corresponding vanes and projections. The waveguide includes an essentially circular input opening for alignment with a compression driver and provides a substantially rectangular output opening from the waveguide.

17 Claims, 3 Drawing Sheets

WAVEGUIDE FOR SHAPING SOUND WAVES

BACKGROUND

The present invention relates to a waveguide for shaping sound waves output by a transducer.

SUMMARY

In one embodiment, the invention provides converts the spherical wave into a plane wave with uniform amplitude over its surface. In other embodiments, the invention creates a predetermined desired curved wave. The result of the invention is better control of sound radiation in angular coverage and in acoustic intensity.

In another embodiment, an acoustic waveguide for shaping waves comprises walls defining a chamber having an input end and an output end with the chamber defined therebetween. An opening at the input end of the waveguide receives sound waves from an acoustic transducer and an opening at the output end of the waveguide outputs sound waves. The waveguide chamber defines a first inner face and a second inner face that is opposing and facing the first inner face. A plurality of projections in alignment is provided on the first inner face and the second inner face and project outwardly therefrom. At least two vanes are disposed on the first inner face of the chamber, the vanes extending from adjacent the opening at the input end and generally toward the output end. The vanes are in alignment with vanes on the second inner face of the chamber.

In some embodiments, the vanes of the waveguide members have a substantially constant thickness along the length thereof. The opening at the input end of the waveguide is typically a circular opening and the opening at the output end is a generally rectangular opening. When assembled, the vanes and the projections typically extend essentially across the entirety of the cavity from the first inner face to the second inner face.

In another embodiment, the waveguide comprises two waveguide members that are mirror images of each other, wherein the first inner face is associated with a first one of the waveguide members and the second inner face is associated with a second one of the waveguide members.

In some embodiments, the waveguide includes a gasket provided between the first waveguide member and the second waveguide member, the gasket providing a seal between the corresponding vanes on the first inner face and the second inner face, and the gasket providing a seal between the projections provided on the first inner face and the corresponding projections provided on the second inner face.

In some embodiments, the plurality of projections comprises at least twenty cylindrical projections. In other embodiments, the plurality of cylindrical projections comprise at least thirty cylindrical projections and the at least two vanes comprises at least three vanes, wherein one of the vanes is centrally oriented along an axis of the waveguide beginning proximate or adjacent the input opening and ending near the output opening.

In one embodiment, at least four of the cylindrical projections are disposed on the inner face a distance from the output opening that is closer to the output opening than a distance from a closest end of the vane to the output opening. In other embodiments, the cylindrical projections are disposed to output an asymmetric curved wavefront or disposed to output a flat plane wave front.

In one embodiment, a horn is disposed at the output end of the waveguide. In another embodiment, a majority of the projections are disposed closer to the output end than to the input end of the waveguide.

In another embodiment of the invention, an acoustic waveguide for shaping waves comprises walls defining a chamber having an input end and an output end with a chamber defined therebetween; an opening at the input end for receiving sound waves from an acoustic transducer; and a substantially rectangular opening at the output end for outputting sound waves. In one embodiment, the chamber defines a first inner face and a second inner face opposing and facing the first inner face. The embodiment includes a plurality of projections provided on the first inner face and projecting outwardly therefrom and at least one vane disposed on the first inner face of the chamber, the vane extending from adjacent the opening at the input end and generally toward the output end.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 2:
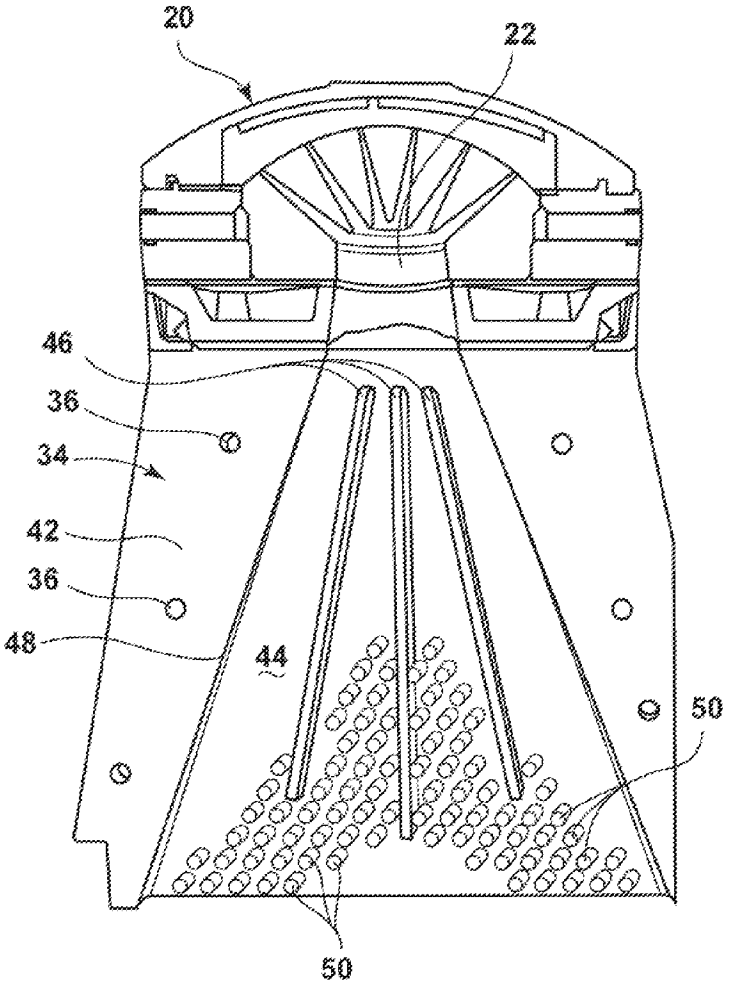
FIG. 2 is a cross sectional view of the transducer unit of FIG. 1 and a perspective view of a waveguide plate.
Figure 1:
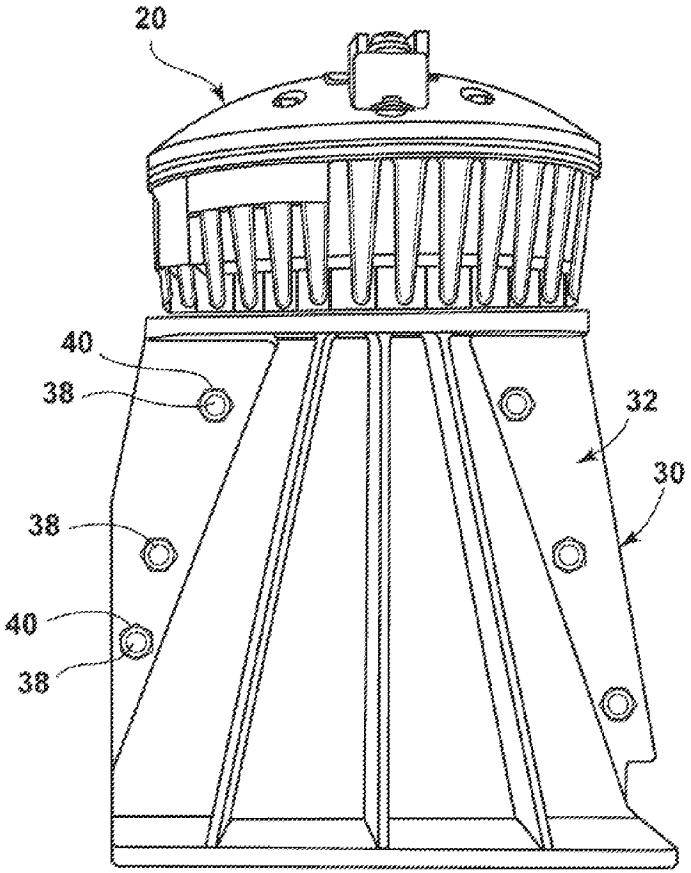
FIG. 1 is a perspective view of a transducer unit and waveguide.

FIGS. 1 and 2 show a transducer unit 20 having a spherical diaphragm and including a compression driver 22 in combination with a waveguide 30. The waveguide 30 includes a first waveguide member 32 shown in FIG. 1 and a second waveguide member 34 shown in FIG. 2. Apertures or open bore holes 36 of the waveguide members 32, 34 are provided in alignment with each other so that fasteners, such as bolts 38 are placed therethrough and secured or locked by nuts 40 or the like to obtain the waveguide 30 shown in FIG. 1.

FIG. 2 shows the waveguide member 34, which includes a generally flat connecting section 42 and a chamber defined by a wall or inner face 44. Within the chamber defined by the inner face 44 are a plurality of elongate vanes 46 defining channels. The inner face 44 is defined by edges 48 of the waveguide member 34. Further, a plurality of projections 50 are disposed projecting inwardly from the inner face 44. For the waveguide member 34, the flat connecting section 42, the vanes 46, the edges 48, and the projections 50 project outwardly essentially the same distance to define a plane. The input end of the waveguide member 34 is shown at the top in FIG. 2 to receive sound waves from the compression driver 22. The output end of the waveguide member 34 is disposed at the bottom end as shown in FIG. 2. The waveguide member 34 shown in FIG. 3 corresponds to the waveguide member shown in FIG. 2.

The waveguide member 32 shown in FIG. 1 is essentially a mirror image of the waveguide member 34. Thus, when the waveguide members 32, 34 are joined, a symmetric or an asymmetric waveguide 30 is formed having a chamber with channels defined by inner faces 44, vanes 46, edges 48 and projections 50. The waveguide members 32, 34 are symmetric or asymmetric depending on the arrangement of the vanes 46 and/or the projections 50.

Figure 4:
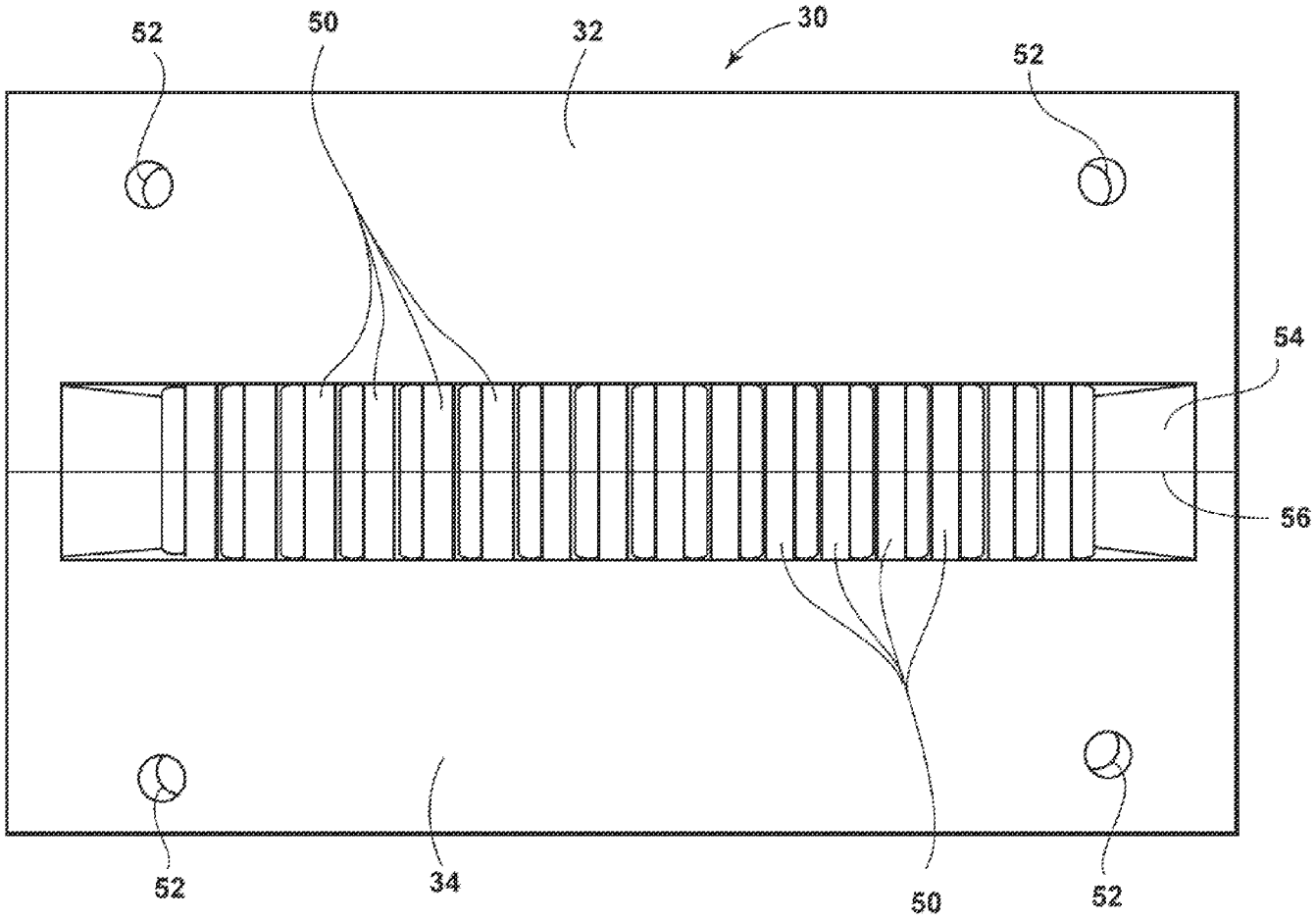
FIG. 4 is a view of the sound wave output end of the waveguide shown in FIG. 1.

FIG. 4 is a view of the output end of the waveguide 30. FIG. 4 shows a portion of the waveguide member 32 and a portion of the waveguide member 34. Each of the waveguide members 32, 34 include open bore holes 52 for the optional attachment of a horn to the output end of the waveguide 30. FIG. 4 also shows an essentially rectangular opening 54 in the output end of the waveguide 30 that defines a sound output path or opening for outputting a sound wave therefrom. The height of the rectangular opening is significantly greater than the width of the opening. In some embodiments, the height is within a range about of 6 to about 7 times greater than the width of the rectangular opening 54.

Further, some of the projections 50 provided with each of the waveguide members 32, 34 are viewable through the rectangular opening 54. In either event, the projections 50 are disposed in essentially flush alignment with corresponding projections from the other waveguide. Likewise, the vanes of the waveguide member 32 are in alignment with and essentially flush with corresponding vanes of the waveguide member 34. Therefore, the vanes 46 define a series of passageways or channels between the input end and the output end of the waveguide 30.

An optional thin gasket 56 is illustrated in FIG. 4. The gasket 56 reduces or eliminates any amount of gap provided between the vanes 46 or between the corresponding facing projections 50 projecting from the inner faces 44. In some embodiments, the waveguide members 32, 34 are molded plastic bodies. Depending on the tolerances and the dimensions of the molded waveguide members 32, 34 and the vanes 46 and projections 50 thereof, a gasket 56 is not provided.

As shown in FIG. 2, a large number of projections 50 are provided in channels formed by the vanes 46. In some embodiments, the projections 50 have a cylindrical shape. In other embodiments, the projections 50 have an elliptical shape, although other shapes are contemplated. In some embodiments, at least twenty projections 50 are required. In other embodiments more than thirty projections 50 are required.

In some embodiments two or more vanes 46 are required for each waveguide 30. In other embodiments, at least three vanes 46 are contemplated. The vanes 46 have an elongate length beginning near the compression driver 22 at the input end and extending toward the output end. In another embodiment, some of the projections 50 are disposed closer to the rectangular opening 54 at the output end of the waveguide 30 than the vanes 50 are with respect to the rectangular opening at the output end of the waveguide. Moreover, the majority of the projections 50 typically are disposed on the half of the inner face 44 that is closest to the rectangular opening 54 at the output end of the waveguide 30.

As shown in FIG. 2, the projections 50 are arranged so that more projections are provided for the inner channels defined by the vanes 46 that have a smaller distance from the compression driver 22 to the rectangular opening 54. The projections 50 of the arrangement are intended to slow the advance of the sound wave so that the sound wave front exits the rectangular opening 54 shown in FIG. 4 at the same rate/time along the height thereof. Thus, in one embodiment a constant wave front results. In some embodiments, the chamber defined by the inner faces 44 of the waveguide 30 increases in height from the input end to the output end of the waveguide in a first direction as shown in FIG. 2, the first direction being transverse to a path from the input end to the output end.

In some embodiments, the chamber of the waveguide remains substantially the same size or smaller in a second direction from the input end to the output end, the second direction being transverse to a path from the input end to the output end in a first plane and also transverse with respect to the direction wherein the chamber typically expands to the height shown by the rectangular opening 54 in FIG. 4. Thus, the width of the opening 54 in this second direction remains narrow for the waveguide as is shown by the width of the rectangular opening 54 of the waveguide 30 in FIG. 4.

In operation, the compression driver 22 acts as a transducer providing a sound wave, typically in the region of 800 Hz to 20 KHz, to an opening at the input end of the waveguide 30. The input opening at the input end of the waveguide 30 has a circular shape that essentially matches the dimensions of the compression driver 22. Within the waveguide 30 shown in FIGS. 2 and 3, the three vanes 46 divide the input sound energy into essentially four paths or channels. The projections 50 reflect the sound waves so that the sound waves reach the opening 54 at essentially the same time along the length thereof. Thus, a flat planar wave is output from the waveguide.

Figure 5:
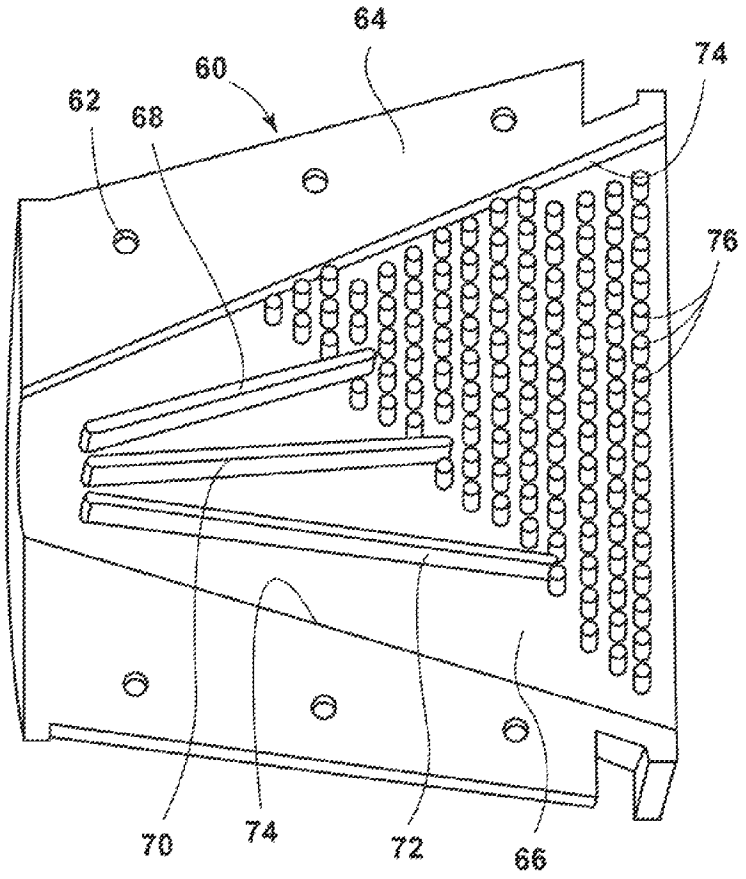
FIG. 5 is a perspective view of another embodiment of the waveguide plate.

FIG. 5 is another embodiment of the waveguide. The asymmetric waveguide member 60 shown in FIG. 5 includes open bore apertures 62, a flat connecting section 64, an inner face 66, three vanes 68, 70, 72, edges 74 and a plurality of projections 76. In the FIG. 5 embodiment, the vanes 68, 70, 72 all begin at locations near or proximate the input end similar to the first embodiment of FIGS. 1-4. The first vane 68, however, has a shorter length than the middle vane 70 and the third vane 72 has the greatest length. Of the four channels formed, a first outer channel nearest and outwardly from the shortest vane 68 has a path with the most projections 76 to obstruct a sound wave. Proceeding to the channels on the other side of vane 68, each channel has fewer projections sequentially and the elongate vanes 70, 72 have progressively longer lengths. Thus, in the FIG. 5 embodiment, the sound wave is output first at the lower end having the path of least resistance and is output more slowly continuously along the entire length of the rectangular opening until reaching the opposing end of the opening. To form a waveguide, a corresponding waveguide member to the waveguide member 60 is provided that is a mirror image thereof. Thus, the projections 76 and the vanes 68, 70, 72 for the corresponding waveguide member have the same lengths and sizes as waveguide member 60 to obtain a matching arrangement resulting in an asymmetric wave front.

The pattern and size of the projections 50 affect the properties of the sound wave that is output from the waveguide. The pattern and size of the projections depend in part on the size of the opening for the compression driver 22.

Figure 3:
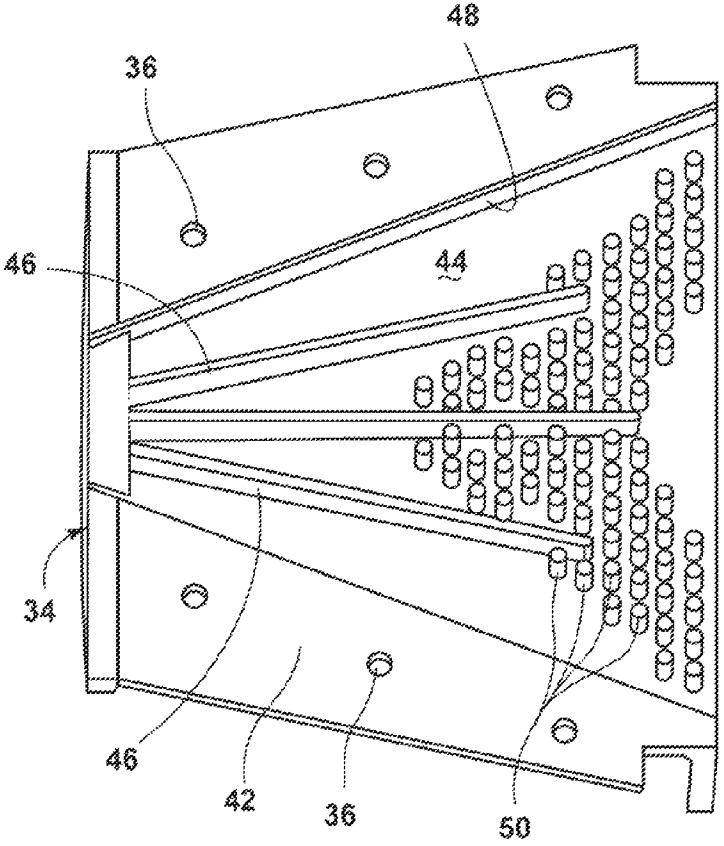
FIG. 3 is a perspective view of the waveguide plate shown in FIG. 2.

As shown in FIG. 3, the plurality of projections 50 are disposed away from the input end of the waveguide 30, wherein sound travels at least about 40% of the distance from the input end toward the output end of the waveguide before contacting one of the projections. Further, the projections are disposed at least about 65% of the distance from the input end to the output end or rectangular opening 54 for some of the channels formed by vanes of the waveguide.

Thus, the invention provides, among other things, a waveguide that can output a flat wave or other waves from an acoustic transducer. Various features and advantages of the invention are set forth in the following claims.

What is claimed is:

1. An acoustic waveguide for shaping waves comprising:

walls defining a chamber having an input end and an output end with the chamber defined therebetween;

an opening at the input end for receiving sound waves from an acoustic transducer;

an opening at the output end for outputting sound waves;

the chamber opening in a first direction from the input end to the output end, the first direction being transverse to a path from the input end to the output end, the chamber defining a first inner face and a second inner face opposing and facing the first inner face;

a plurality of projections provided on the first inner face and projecting outwardly therefrom; and at least two vanes disposed on the first inner face of the chamber, the vanes extending from proximate the opening at the input end and generally toward the output end.

2. The waveguide of claim 1, wherein the vanes have a substantially constant thickness along the length thereof.

3. The waveguide of claim 1, wherein the opening at the input end comprises a circular opening and the opening at the output end comprises a generally rectangular opening.

4. The waveguide of claim 1, wherein the vanes and the projections extend substantially across the entirety of the cavity from the first inner face to the second inner face.

5. An acoustic waveguide for shaping waves comprising:

walls defining a chamber having an input end and an output end with the chamber defined therebetween;

an opening at the input end for receiving sound waves from an acoustic transducer;

an opening at the output end for outputting sound waves;

the chamber opening in a first direction from the input end to the output end, the first direction being transverse to a path from the input end to the output end, the chamber defining a first inner face and a second inner face opposing and facing the first inner face;

a plurality of projections provided on the first inner face and projecting outwardly therefrom;

at least two vanes disposed on the first inner face of the chamber, the vanes extending from proximate the opening at the input end and generally toward the output end;

a plurality of projections provided on the second inner face and projecting outwardly therefrom, the projections on the second inner face being in alignment with the projections on the first inner face; and at least two vanes disposed on the second inner face of the chamber, the vanes on the second inner face of the chamber being in alignment with the vanes on the first face of the chamber, wherein the waveguide comprises two waveguide members that are mirror images of each other, wherein the first inner face is associated with a first one of the waveguide members and the second inner face is associated with a second one of the waveguide members.

6. The waveguide of claim 5, further comprising a gasket provided between the first waveguide member and the second waveguide member, the gasket providing a seal between the vanes on the first inner face and the second inner face, and the gasket providing a seal between the projections provided on the first inner face and the projections provided on the second inner face.

7. The waveguide of claim 1, wherein the plurality of projections comprises at least twenty cylindrical projections.

8. The waveguide of claim 6, wherein the plurality of cylindrical projections comprise at least thirty cylindrical projections and the at least two vanes comprises at least three vanes, wherein one of the vanes is centrally oriented along an axis of the waveguide beginning proximate the input opening and ending near the output opening.

9. The waveguide of claim 7, wherein at least four of the cylindrical projections are disposed on the inner face a distance from the output opening that is closer than a distance from a closest end of the vane from the output opening.

10. The waveguide of claim 1, wherein the projections comprise cylindrical projections and the cylindrical projections are disposed to output an asymmetric curved wavefront.

11. The waveguide of claim 1, wherein the projections comprise cylindrical projections and the cylindrical projections are disposed to output a flat plane wave front.

12. The waveguide of claim 1, further comprising a horn disposed at the output end of the waveguide.

13. The waveguide of claim 1, wherein a majority of the projections are disposed closer to the output end than to the input end of the waveguide.

14. An acoustic waveguide for shaping waves comprising:

walls defining a chamber having an input end and an output end with a chamber defined therebetween;

an opening at the input end for receiving sound waves from an acoustic transducer;

a substantially rectangular opening at the output end for outputting sound waves;

the chamber opening in a first direction from the input end to the output end, the first direction being transverse to a path from the input end to the output end, the chamber defining a first inner face and a second inner face opposing and facing the first inner face, and the opening chamber in the first direction defining the height of the rectangular opening at the output end;

a plurality of projections provided on the first inner face and projecting outwardly therefrom; and at least one vane disposed on the first inner face of the chamber, the vane extending from proximate the opening at the input end and generally toward the output end.

15. The acoustic waveguide of claim 14, wherein the plurality of projections are disposed away from the input end of the waveguide, wherein sound travels at least about 40% of the distance from the input end to the output end of the waveguide before contacting one of the projections.

16. The acoustic waveguide of claim 14, wherein the at least one vane comprises one of at least three vanes extending from proximate the opening at the input end and generally toward the output end.

17. The waveguide of claim 14, wherein the plurality of projections comprise at least thirty projections and the at least one vane comprises at least three vanes, wherein one of the vanes is centrally oriented along an axis of the waveguide beginning proximate the input opening and ending near the output opening.

* * * * *